United States Patent [19]

Schimmel

[11] Patent Number: 4,463,925

[45] **Date of Patent: * Aug. 7, 1984**

[54] CONCRETE FORM STRUCTURE INCLUDING ONE-WAY ESCAPE HINGE

[75] Inventor: Vernon R. Schimmel, Lincolnwood, Ill.

[73] Assignee: Symons Corporation, Des Plaines, Ill.

[ * ] Notice: The portion of the term of this patent subsequent to Dec. 6, 2000 has been disclaimed.

[21] Appl. No.: 393,613

[22] Filed: Jul. 2, 1982

[51] Int. Cl.[3] ..... E04G 15/06; B28B 7/30

[52] U.S. Cl. ..... 249/11; 249/27; 249/170; 249/182; 249/185

[58] Field of Search ..... 249/170, 171, 172, 185, 249/11, 27, 182, 12

[56] References Cited

U.S. PATENT DOCUMENTS

| | | | |
|---|---|---|---|
| 1,258,923 | 3/1918 | Marqua et al. | 249/185 X |
| 3,601,996 | 8/1971 | Levy | 249/185 X |
| 3,815,861 | 6/1974 | Maier | 249/185 X |
| 4,017,052 | 4/1977 | Azzaroni | 249/185 X |
| 4,055,321 | 10/1977 | Schimmel | 249/185 X |
| 4,210,306 | 7/1980 | Schimmel | 249/196 |

*Primary Examiner*—Donald E. Czaja
*Assistant Examiner*—James.C. Housel
*Attorney, Agent, or Firm*—Charles F. Meroni, Jr.

[57] ABSTRACT

A concrete forming structure including a collapsible form having at least one form panel section. The section having a marginal flange structure mounted thereon at one side and vertically spaced slots on the marginal flange structure for receiving wedge bolts at selected intervals. A one-way escape hinge structure for the form including a pair of first and second hinge plates, the hinge plates including a hinge securing said plates at one of their ends. The first of said hinge plates having vertically spaced wedge bolt slots spaced at intervals generally coinciding to the spacing of the slots on the marginal flange of the panel section. Locking pairs of wedge bolts each having an enlarged end are provided. One wedge bolt of each pair extends through the cooperating slots in the first hinge plate and the marginal flange structure of the panel section with its enlarged end resting against the hinge plate. The other wedge bolt of each pair extending transversely through a slot in the wedge bolt locking the pair of wedge bolts in assembly to secure the hinge plate to the marginal flange structure of the panel section. The second hinge plate has an angle. Means secures one angle leg of the angle in assembly with the second hinge plate. The second hinge plate has spaced clearance slots each alignable with one of the slots in the first hinge plate and the enlarged end of the wedge bolt extending through the second hinge plate for allowing the hinge plate to be positioned in parallel relation to one another. Spacer pads mounted on one of the hinge plates for holding the hinge plates apart and having a thickness sufficient to allow the hinge plates to be positioned in generally parallel relationship without interference from the enlarged ends of the wedge bolts extending through the first hinge plate.

16 Claims, 8 Drawing Figures

CONCRETE FORM STRUCTURE INCLUDING ONE-WAY ESCAPE HINGE

The present invention relates generally to concrete forms and has particular reference to several new and improved articulated collapsible forms which are adapted for use in the formation of concrete structures such as a tunnel, a culvert, and concrete walls with or without pilasters. In accordance with my invention, I have provided a unique one-way escape hinge structure which is to function where dimensional stripping relief must be generated directly at the bottom, side, or top edge of a gang form where it abuts at right angles to previous poured concrete or other existing structures. As an example, tunnel or culvert gang forms have sidewalls of the gang forms that bear directly on a previously poured base slab or invert and in a situation of this type, the one-way escape hinge structure functions to foreshorten the vertical wall form height dimension a distance sufficient to provide the necessary travel clearance for the form to be released from the concrete. It is contemplated that with the one-way escape structure that the vertical wall form height dimension can be foreshortened in the range of one and one half to four inches.

Another important commercial advantage of using my one-way escape hinge structure is that it is no longer necessary to build a starter wall.

The present state of the art method is to include the costly addition of starter walls (approximately 6" high), which normally are tediously formed and poured with the invert or base slab. The tunnel wall forms are then elevated and blocked up several inches off the invert to a lap position on a starter wall. The blocking is later removed to provide stripping relief and travel clearance. Starter walls are costly from the standpoint of the added time required to build them and the labor involved in doing so. With the gang form embodying my invention and including a one-way escape hinge structure, the hinge structure is positioned on a side end of the gang form wherein it will generate two inches of dimensional stripping relief to clear an adjoining structure.

It is, therefore, an important object of this invention to provide a new and improved collapsible form in combination with a one-way escape hinge structure that can be used for pouring different types of concrete walls for use in structures such as a tunnel, a culvert, and concrete walls with or without pilasters whereby the form can be readily stripped from the poured wall and where no starter walls are required for positioning the form.

According to other important features of my invention, I have provided a concrete forming structure which includes a collapsible form having at least one form panel section having a marginal flange structure mounted thereon at one side and vertically spaced slots on the marginal flange structure for receiving wedge bolts at selected intervals, the improvement comprising a one-way escape hinge structure including a pair of first and second hinge plates, the hinge plates including a hinge securing said plates at one of their ends, the first of said hinge plates having vertically spaced bolt slots spaced at intervals generally coinciding to the spacing of the slots on the marginal flange of the panel section, fastener means for joining the first hinge plate to said marginal flange structure including bolts each having an enlarged end, the bolts extending through the cooperating slots in the first hinge plate and the slots in the marginal flange structure of the panel section with its enlarged end resting against the hinge plate and with its opposite end secured to secure the hinge plate to the marginal flange structure of the panel section, the second hinge plate having an angle, means securing one angle leg of the angle in assembly with the second hinge plate, the second hinge plate having spaced clearance slots each alignable with one of the slots in the first hinge plate and the enlarged end of the bolt extending through the second hinge plate for allowing the hinge plates to be positioned in parallel relation to one another, and a spacer pad mounted on one of the hinge plates for holding the hinge plates apart and having a thickness sufficient to allow the hinge plates to be positioned in generally parallel relationship without interference from the enclosed ends of the bolts extending through said first hinge plate.

According to other features of my invention, the concrete forming structure can be used as a series gang forms where the sidewalls of the gang forms bear directly on a previously poured base slab and with the one-way escape hinge structure being collapsible to foreshorten a vertical wall form height dimension of the order of two inches, thus permitting the collapsible form to release from the concrete, the one-way escape hinge structure providing the necessary travel clearance.

With respect to other features of my invention, the concrete forming structure is also useable with other forms for forming a concrete wall in combination with pilasters.

Still other features of the invention concern the use of the form panel structure in combination with a second angle leg which together have forming faces lying in a common plane when the first and second hinge plates are disposed in generally parallel relation and with the faces of the form panel section and the second angle leg being in diverging relation when the one-way escape hinge structure is retracted.

Yet other features of my invention concern the use of the spacer pad having a pad face in engagement with the first hinge plate when the forming faces of the form panel section and the second angle leg are disposed in a common plane relative to one another.

Numerous other objects and advantages of the invention not at this time enumerated, will readily suggest themselves as the following description ensues.

The invention comprises several novel features which are hereafter set forth and are more particularly defined by the claims at the conclusion hereof.

In the accompanying two sheets of drawings forming a part of this specification, several embodiments of the invention are shown.

IN THE DRAWINGS

Figure 3:
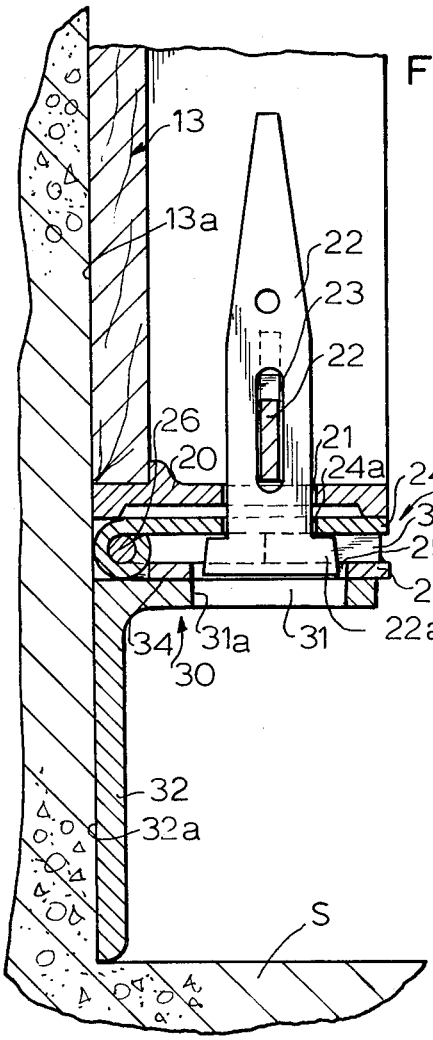
FIG. 3 is an enlarged fragmentary vertical section of the one-way escape hinge structure shown in FIG. 1 and illustrating the operation of the various components and embodying features of my invention.
Figure 4:
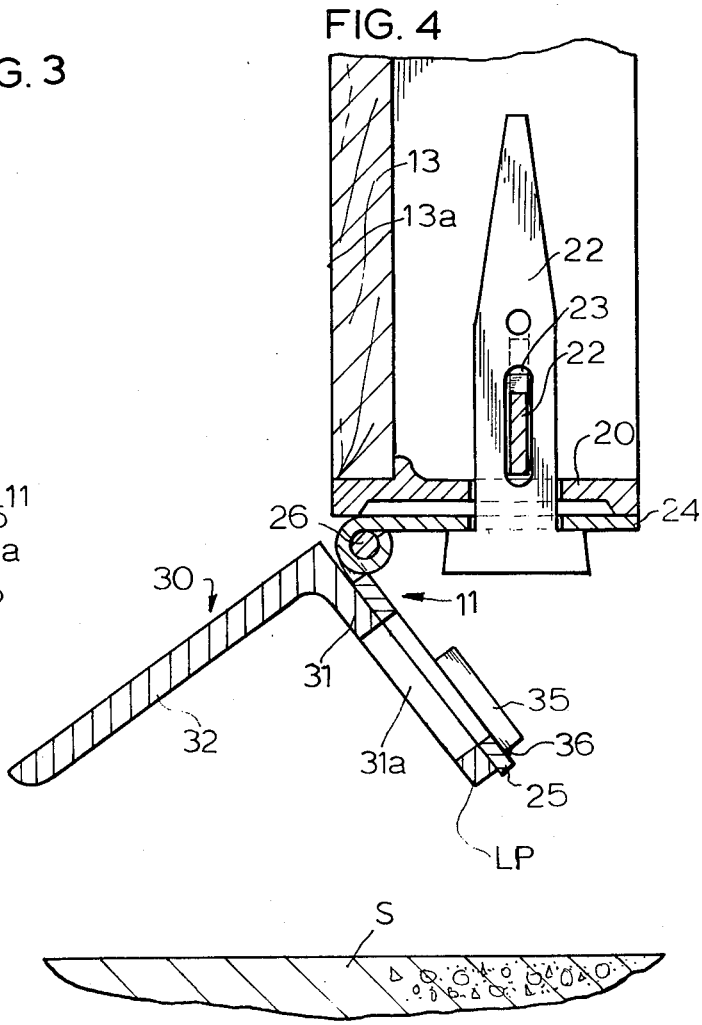
Figure 5:
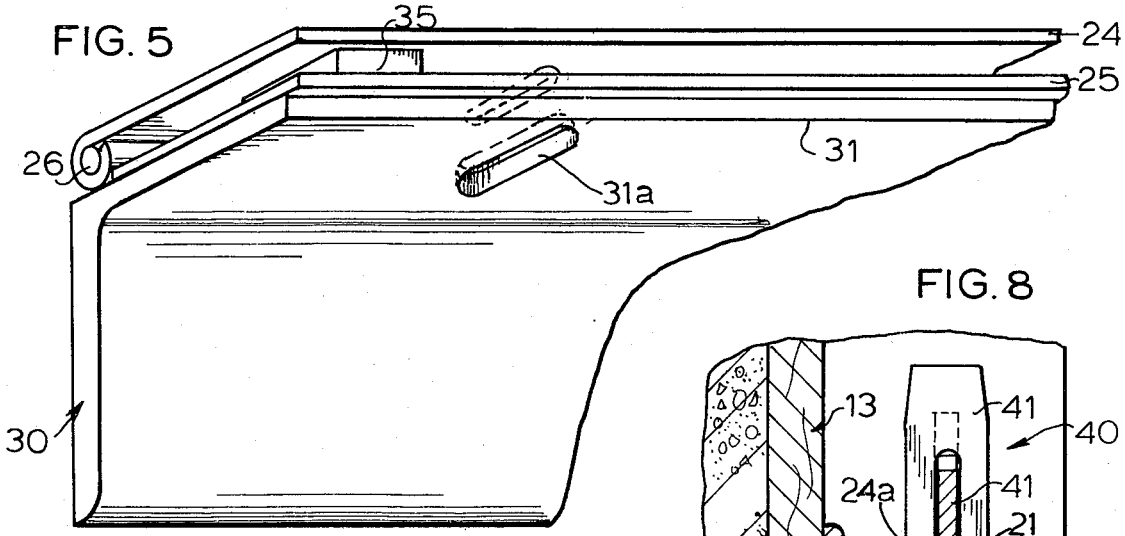
Figure 8:
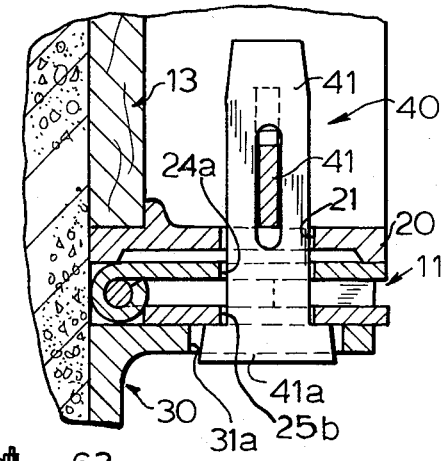
Figure 6:
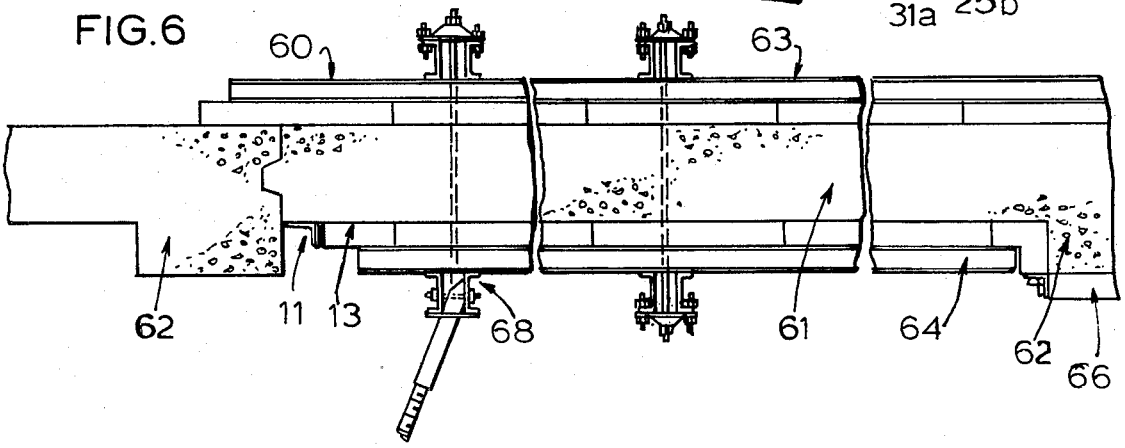
Figure 7:
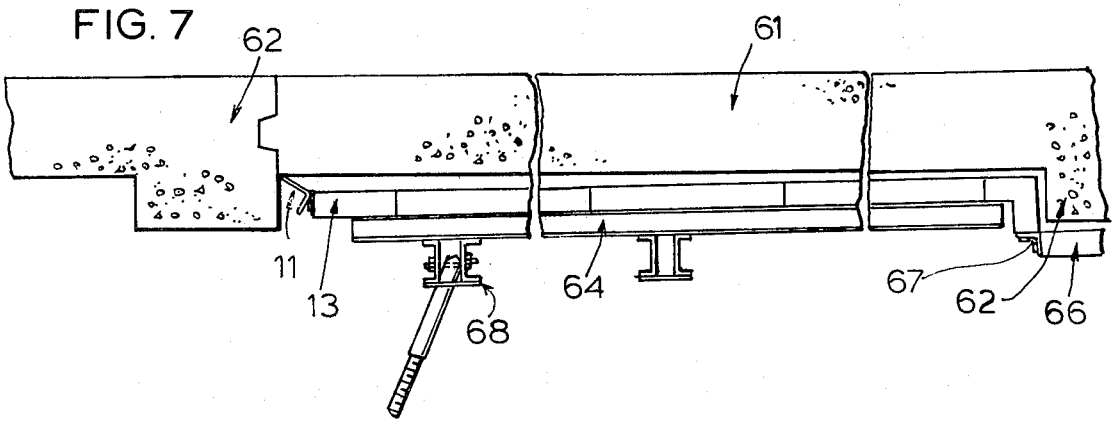

FIG. 4 is a view similar to FIG. 3 only illustrating the one-way escape hinge structure in a modified retracted position;

FIG. 5 is an enlarged fragmentary perspective view of the one-way escape hinge structure illustrated in FIGS. 3 and 4;

FIG. 6 is an enlarged fragmentary plan view of a concrete forming structure including a collapsible form for forming a poured concrete wall with pilasters and where the collapsible form includes a one-way escape hinge structure;

FIG. 7 is a view similar to FIG. 6 except showing the one-way escape hinge structure in a collapsed position; and FIG. 8 is an enlarged fragmentary cross-sectional view showing other features of my one-way escape hinge structure.

Figure 1:
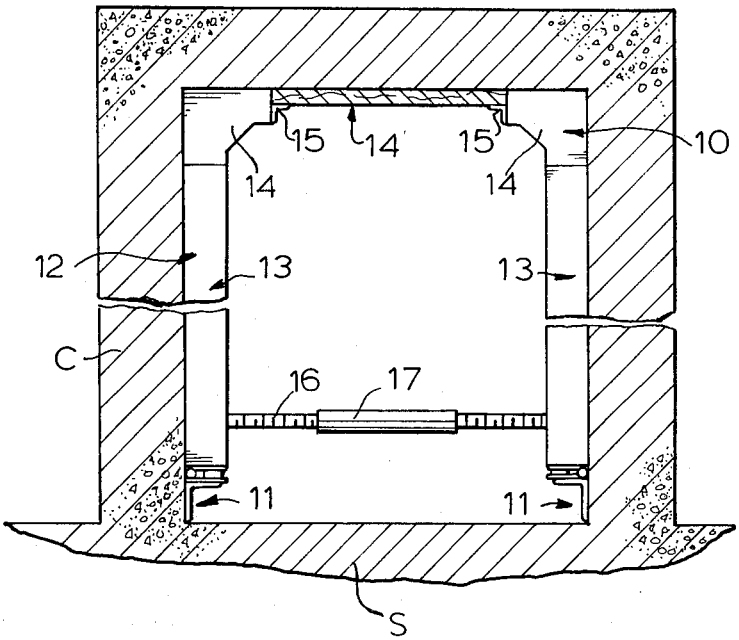
FIG. 1 is a schematic front view of a conrete form structure for forming a tunnel section with the form structure including one-way escape hinge structures embodying important features of my invention.

Referring now to the drawings in detail and in particular to FIGS. 1, 3, and 4, there is disclosed in these views a concrete forming structure 10, for forming a tunnel or culvert C which is formed for the most part of concrete. The present invention is concerned with the construction of the concrete forming structure for forming the illustrated section of a tunnel in the usual manner by pouring wet concrete into the forms.

Included with the concrete forming structure 10, as well as with the other forms of my invention, is a one-way escape hinge structure 11 which embodies important new features of my invention when used in combination with a collapsible form 12 as illustrated in FIG. 1. The collapsible form 12 can be in other forms other than the one shown in FIG. 1, such as the form 50 shown in FIG. 2 or such as in the form 60 shown in FIGS. 6 and 7. In all forms, the one-way hinge structure 11 serves essentially the same purpose since it is adapted to function where dimensional stripping relief is generated directly at the bottom, side or top edge of a gang form where it abuts at right angles to previous poured concrete or other existing structures.

Tunnel or culvert gang forms 10 can now be used where the side walls of the ganged forms bear directly on the previously poured base slab or invert S. The one-way escape hinge assembly or structure 11 functions to foreshorten the vertical wall form height dimension 2 inches. This permits wall form release from the concrete, and provides necessary travel clearance above the invert or slab S as is shown in FIG. 4. The present state of the art method is to include the costly addition of starter walls (approximately six inches high), which normally is tediously formed and poured with the invert. The tunnel wall forms are then elevated and blocked up several inches off the invert to a lap position on the starter wall. The blocking is later removed to provide stripping relief and travel clearance. Starter walls are costly (time and labor).

On an application where a ganged form abuts an existing structure, the one-way escape hinge structure 11 positions on the side end of the gang form wherein it will generate up to two inches of dimensional stripping relief to clear the adjoining structure.

The one-way escape hinge assembly or structure 11 is best illustrated in FIGS. 3, 4, and 8, and shall now be described in greater detail. As mentioned before, when the escape hinge structure 11 is in its retracted position as illustrated in FIG. 4, there is a two inch clearance which develops between the lowest point of the retracted hinge structure at L.P. with respect to a previously poured base S and for purposes of identification the position of the retracted one-way escape hinge structure is identified in FIG. 4 as being in its stripping position as contrasted to FIG. 3 where the hinge structure 11 is shown in its so-called pour position. In all other Figures of the drawings herein, the hinge structure 11 is shown in the so-called pour position, except for FIG. 4.

Cooperable with the one-way escape hinge structure 11 is a collapsible form generally indicated at 12 which specifically includes at least one form panel section 13. The concrete forming structure 10 also includes conventional rigid corners 14—14 and a horizontal form 14' held in position with respect to the rigid corners 13 by means of suitable detachable corner supports 15—15. The upright form panel sections 13—13 are held in position by means of suitable braces 16 that can be adjusted by means of operating the turn buckles 17. Any suitable number of these braces 16 can be used as may be needed and as is known in this art.

The form panel sections are of the "STEEL-PLY" type and have been selected for exemplary illustration herein. This panel unit which has been found admirably well-adapted for use in connection with the present invention is a panel which is known as a "STEEL-PLY" panel. Such a panel is manufactured and sold by Symons Corporation. A typical "STEEL-PLY" panel unit is shown and described in U.S. Pat. No. 3,357,673, granted on Dec. 12, 1967, and entitled "Concrete Wall Form With A Particular Panel Hinge Arrangement".

The form panel section 13 has a marginal flange structure 20 mounted thereon at one side and vertically spaced slots 21 are disposed at suitable spacings such as at 12 inch intervals along the marginal flange structure for receiving wedge bolts 22 or other suitable fasteners such as nut and bolt assemblies at selected intervals for joining the one-way escape hinge structure thereto in accordance with my invention. As seen in FIG. 3, the wedge bolts 22 have central slots 23 so that the bolts can be assembled at right angles to one another for securing the one-way escape hinge structure 11 in assembly therewith.

The one-way escape hinge structure 11 includes a pair of first and second hinge plates 24 and 25 which plates are secured together by means of a hinge or hinge pin 26. The hinge structure 11 is of the piano-hinge type that is well known in industry. Each hinge plate 24 and 25 has a bolt slot **24*a* and 25*a* which are coaxially aligned with respect to one another and also coaxially alignable with respect to the slots 21 in the marginal flange structure provided on the form panel section 13. It will further be seen that the slot 25*a* is slightly oversize so that a headed end of the wedge bolt can nest therein thereby enabling the hinge plates 24 and 25 to be maintained in parallel relation without interference from the wedge bolt head. When the hinge structure 11 is assembled to the marginal flange structure 20 it will be seen that the headed end 22*a* of the wedge bolt rests against one face of hinge plate 24 and is lodged in the slot 25*a* in the opposing hinge plate 25. Since the diameter of the slot 24*a* is smaller than the head 22*a* of the wedge bolt 22, the bolt cannot pass through the hinge plate 24 and can then be locked in assembly to the marginal flange structure 20 by means of the other wedge bolt being extended through slot 23 all as is shown in FIG. 3**.

Attached to the wedge plate 25 is an angle 30 having angle legs 31 and 32 with leg 32 being longer than leg 31. Leg 31 has an angle leg slot 31*a* which allows the form structure 10 to be positioned on a base slab or invert S in position for a concrete pour. Then the wedge bolts can be moved through the slot 31*a* into position with the headed end 22*a* in abutment against the wedge plate 24 for assembly with the marginal flange structure 20 of the form panel section 13 as previously described. The angle 30 is welded at 34 to the wedge plate 25.

In order to insure that the plates 24 and 25 are maintained in parallel relation to one another so that concrete forming faces 13*a* and 32*a* on the section 13 and the angle leg 32 maintain coplanar, the structure 11 is provided with a series of steel pads which are welded at 36 to wedge plate 25. Any suitable number of steel pads 35 can be provided. Preferably, these pads can be mounted at the same interval with the slots 25*a* such as every twelve inches. Thus, the spacer pads when mounted on one of the hinge plates serve to hold the hinge plates apart and since they have a thickness to allow the hinge plates to be positioned in generally parallel relationship and further since the headed head of the wedge bolts extend into hinge plate slots 25*a*, the concrete forming faces 13*a* and 32*a* can be coplanar relative to one another. While I have used wedge bolts to attach the hinge assembly 11 to the panel section 13 any suitable fastener can be used including nut and bolt units.

Thus, when it is desired to disassemble the concrete forming structure 10 from the poured Culvert or tunnel, the braces 16 and the turnbuckle 17 can be released and cause the section 13 to be swung and moved towards one another by moving the hinge plate 25 on hinge pin 26 thereby causing the angle 30 to pivot into its so-called travel position as is shown in FIG. 4. In order to insure that the hinge plates 24 and 25 will be maintained in generally parallel relation prior to the pouring of the concrete, means or structure has been provided to positively lock the legs 24 and 25 in a clamp assembly with pad 35 all as is seen in FIG. 8. The structure is indicated generally at 40 for accomplishing this objective. The structure 40 comprises a pair of wedge bolts 41—41 which coact with the escape hinge 11 by passing through slots 31*a*, 25*b*, 24*a*, and slot 21. It will be seen that the angle slot 31*a* is larger than wedge bolt head 41*a* whereas slot 25*b* is smaller than wedge bolt 41*a* so that the head can rest against hinge plate 25 and be secured in snug engagement therewith when the top side wedge bolt 41 is engaged on the inside of the marginal flange structure 20 of the section 13. Thus, when the wedge bolts 41—41 are used in the manner just described, the swinging angle 30 is locked in the position shown in FIG. 3 and cannot be allowed to move into the swing position shown in FIG. 4. Note that slot 25*a* in FIG. 3 is larger than slot 25*b* in FIG. 8 and occurs at different locations along the plate or leaf 25. If desired the wedge bolts 41—41 could be locked on an opposite side of the hinge structure 11 as seen in FIG. 8 in which event slots 25*a* and 25*b* can be of the same size.

Figure 2:
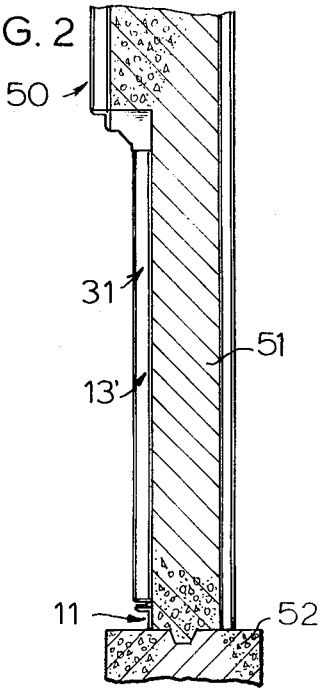
FIG. 2 is a fragmentary side view with a poured concrete wall shown in section illustrating a modified collapsible form including a one-way escape hinge structure for forming a vertical wall and embodying other features of my invention.

FIGS. 2, 6, and 7 show other applications for my one-way escape hinge structure 11 and it will be appreciated that this one-way hinge structure 11 can be used with other types of gang forms and still provide the same advantages and savings in cost.

In FIG. 2, there is illustrated a modified concrete form structure 50 for forming a vertical concrete wall 51 on a concrete slab or invert 52 without the need to pour a starter wall as previously described.

The form 50 includes a gang-type group of forms which are generally conventional in construction and includes a form panel section 13' which is basically of the same construction as section 13 previously described herein. Thus, after the forms are set up in the manner shown in FIG. 2 and after the wet concrete 51 has been poured, the escape hinge structure 11 can be caused to move from its position, as shown in FIG. 3, to the position shown in FIG. 4 to thereby enable the section 13' to be moved away from the formed concrete wall 51.

In FIGS. 6 and 7 there is shown a modified concrete forming structure which is indicated generally at 60. Structures of the general type illustrated are generally known in the art and in this connection attention is directed to FIGS. 9 and 10 in my companion co-pending U.S. application for patent Ser. No. 338,345.

The form structure 60 is illustrated for forming a concrete wall 61 with spaced pilasters 62 integral therewith. Here an outer form 63 is employed which is comprised of a series of side-by-side panel units or panel sections 13 of the same type previously discussed before. An inner form 64 is also illustrated. Form 64 may include a series of panel units which are joined together and which coact with the one-way hinge structure 11. In addition a pilaster form unit 66 is provided for attachment to the rigid corner through the use of an attachment angle 67 (FIG. 6) and wedge bolts. In the arrangement shown in FIGS. 6 and 7, it is now possible to form a wall with integral pilasters 62 and to then strip the inside form 64 by the use of the new and improved one-way hinge filler structure 11. It will be appreciated that a conventional wall tie structure 68 is used to hold the outside form 63 and the inside form 64 in fixed relation to allow the concrete to be poured.

I claim:

1. In a concrete forming structure including a collapsible form having at least one form panel section having a marginal flange structure mounted thereon at one side and vertically spaced slots on the marginal flange structure for receiving wedge bolts at selected intervals, the improvement comprising a one-way escape hinge structure including a pair of first and second hinge plates, the hinge plates including an escape hinge securing said plates together at one of their ends, the escape hinge lying generally in a plane extended inside of an outside forming face of the form panel section, the first of said hinge plates having vertically spaced wedge bolt slots spaced at intervals generally coinciding to the spacing of the slots on the marginal flange of the panel section, locking pairs of wedge bolts each having an enlarged end, one wedge bolt of each pair extending through the cooperating slots in the first hinge plate and the marginal flange structure of the panel section with its enlarged end resting against the hinge plate and with the other wedge bolt of each pair extending transversely through a slot in the wedge bolt locking the pair of wedge bolts in assembly to secure the hinge plate to the marginal flange structure of the panel section, the second hinge plate having an angle, means securing one angle leg of the angle in assembly with the second hinge plate, the second hinge plate having spaced clearance slots each alignable with one of the slots in the first hinge plate and the enlarged end of the wedge bolt extending through the second hinge plate for allowing the hinge plates to be positioned in parallel relation to one another, the angle including a second load bearing angle leg being constructed and sized so as to provide sole load bearing strength in the vertical direction when in load bearing ground engagement when in a pour position and lying in the same plane of the forming face of the associated form panel section and with both angle legs and said second hinge plate swingable together on said escape hinge freeing the second angle leg from an engaged position to an escape position thus allowing the collapsible form to be freed and moved to a new position for a subsequent pour, the second leg of said angle being continuous to provide rigidity and to enable the second leg to provide a concrete seal and to act as part of the mold without recourse to any bracing means, and a spacer pad mounted on one of the hinge plates for holding the hinge plates apart and having a thickness sufficient to allow the hinge plates to be positioned in generally parallel relationship without interference from the enlarged ends of the wedge bolts extending through said first hinge plate.

2. The concrete forming structure of claim 1 further characterized as including a series of gang forms where the sidewalls of the gang forms bear directly on a previously poured base slab, the one-way escape hinge structure being collapsible to foreshorten a vertical wall form height dimension in the range of 1½" to 4", thus permitting the collapsible form to release from the concrete, the one-way escape hinge structure providing the necessary travel clearance.

3. The concrete forming structure of claim 1 further characterized by being cooperable with other forms for forming a concrete wall in combination with pilasters, the one-way escape hinge structure being collapsible to foreshorten the length of the form dimension in the range of 1½" to 4" for enabling the collapsible form to be disengaged from the poured concrete wall and its poured pilasters.

4. The concrete forming structure of claim 1 further characterized by the form panel section and a second angle leg having forming faces lying in a common plane when the first and second hinge plates are disposed in generally parallel relation and with the faces of the form panel section and the second angle leg being in diverging relation when the one-way escape hinge structure is collapsed.

5. The concrete forming structure of claim 4 further characterized by the spacer pad having a pad face in engagement with the first hinge plate when the forming faces of the form panel section and the second angle leg are disposed in a common plane relative to one another.

6. The concrete forming structure of claim 2 further characterized by the form panel section and a second angle leg having forming faces lying in a common plane when the first and second hinge plates are disposed in generally parallel relation and with the faces of the form panel section and the second angle leg being in diverging relation when the one-way escape hinge structure is collapsed.

7. The conrete forming structure of claim 4 further characterized by the spacer pad having a pad face in engagement with the first hinge plate when the forming faces of the form panel section and the second angle leg are disposed in a common plane relative to one another.

8. In a concrete forming structure for forming tunnels and/or culverts including a collapsible form having a spaced pair of form panel sections, each of these sections having a marginal flange structure mounted thereon at one side and vertically spaced slots on the marginal flange structure for receiving wedge bolts at selected intervals, the improvement comprising an escape hinge structure for each of said form panel sections including a pair of first and second hinge plates, the hinge plates including an escape hinge securing said plates together at one of their ends, the escape hinge lying generally in a plane extended inside of an outside forming face of the associated form panel section, the first of said hinge plates having vertically spaced bolt slots spaced at intervals generally coinciding to the spacing of the slots on the marginal flange of the panel section, fastener means for joining the first hinge plate to said marginal flange structure including bolts each having an enlarged end, the bolts extending through the cooperating slots in the first hinge plate and the slots in the marginal flange structure of the panel section with its enlarged end resting against the hinge plate and with its opposite end secured to secure the hinge plate to the marginal flange structure of the panel section, the second hinge plate having an angle, means securing one angle leg of the angle in assembly with the second hinge plate, the second hinge plate having spaced clearance slots each alignable with one of the slots in the first hinge plate and the enlarged end of the bolt extending through the second hinge plate for allowing the hinge plates to be positioned in parallel relation to one another, the angle including a second load bearing angle leg being constructed and sized so as to provide sole load bearing strength in the vertical direction when in load bearing ground engagement when in a pour position and lying in the same plane of the forming face of the associated form panel section and with both angle legs and said second hinge plate swingable together on said escape hinge freeing the second angle leg forming an engaged position to an escape position thus allowing the collapsible form to be freed and moved to a new position for a subsequent pour, the second leg of said angle being continuous to provide rigidity and to enable the second leg to provide a concrete seal and to act as part of the mold without recourse to any bracing means, and a spacer pad mounted on one of the hinge plates for holding the hinge plates apart and having a thickness sufficient to allow the hinge plates to be positioned in generally parallel relationship without interference from the enclosed ends of the bolts extending through said first hinge plate, and means for moving the spaced pair of panel sections in a direction generally toward one another and thereby causing the angles to pivot on the escape hinges thus collapsing the concrete form structure.

9. The concrete forming structure of claim 8 further characterized as including a series of gang forms where the sidewalls of the gang forms bear directly on a previously poured base slab, the one-way escape hinge structure being operable to foreshorten a vertical wall form height dimension in the range of 1½" to 4", thus permitting the collapsible form to release from the concrete, with the one-way escape hinge structure providing necessary travel clearance.

10. The concrete forming structure of claim 8 further characterized by being cooperable with other forms for forming a concrete wall in combination with pilasters, the one-way escape hinge structure being operable to foreshorten the length of the form dimension in the range of 1½" to 4" for enabling the collapsible form to be disengaged from the poured concrete wall and its poured pilasters.

11. The concrete forming structure of claim 20 further characterized by the form panel section and the second hinge plate having forming faces lying in a common plane when the first and second hinge plates are disposed in generally parallel relation and with the faces of the form panel section and the second hinge plate being in diverging relation when the on-way escape hinge structure is collapsed.

12. The concrete forming structure of claim 11 further characterized by the spacer pad having a pad face in engagement with the first hinge plate when the forming faces of the form panel section and the second angle leg are disposed in a common plane relative to one another.

13. The concrete forming structure of claim 8 further characterized by wedge bolt fastener means positively joining the hinge plates in fixed non-pivotal relation to insure against accidental pivoting of the hinged second hinge plate and the angle secured thereto.

14. In a concrete forming structure including a collapsible form having at least one form panel section, the section having a marginal flange structure mounted thereon at one side and vertically spaced slots on the marginal flange structure for receiving wedge bolts at selected intervals, the improvement comprising a one-way escape hinge structure including a pair of first and second hinge plates, the hinge plates including an escape hinge securing said plates at one of their ends, the escape hinge lying generally in a plane extended inside of an outside forming face of the form panel section, the first of said hinge plates having vertically spaced bolt slots spaced at intervals generally coinciding to the spacing of the slots on the marginal flange of the panel section, fastener means for joining the first hinge plate to said marginal flange structure including bolts each having an enlarged end, the bolts extending through the cooperating slots in the first hinge plate and the slots in the marginal flange structure of the panel section with its enlarged end resting against the hinge plate and with its opposite end secured to secure the hinge plate to the marginal flange structure of the panel section, the second hinge plate having an angle, means securing one angle leg of the angle in assembly with the second hinge plate, the angle including a second angle leg being constructed and sized so as to provide sole load bearing strength in the vertical direction when in engagement when in a pour position and lying in the same plane of the outside forming face of the associated form panel section and with both angle legs and said second hinge plate swingable together on said escape hinge freeing the second angle leg from its pour position to an escape position thus allowing the collapsible form to be freed and moved to a new position for a subsequent pour, the second leg of said angle being continuous to provide rigidity and to enable the second leg to provide a concrete seal and to act as part of the mold without recourse to any bracing means.

15. The concrete forming structure of claim 14 further characterized by said one angle leg of the angle having spaced clearance angle slots coaxially aligned with the slots in said other hinge plate for enabling free passage of the bolts therethrough to facilitate assembly of the hinge structure with the marginal flange structure of the panel section.

16. The concrete forming structure of claim 14 further characterized by a spacer pad being mounted on one of the hinge plates for holding the hinge plates apart and having a thickness sufficient to allow the hinge plates to be positioned in generally parallel relationship interference from the enclosed ends of the bolts extending through said first hinge plate, and wedge bolt fastener means positively joining the hinge plates in fixed non-pivotal relation to insure against accidental pivoting of the hinged second hinge plate and the angle secured thereto.

* * * * *

UNITED STATES PATENT AND TRADEMARK OFFICE

CERTIFICATE OF CORRECTION

PATENT NO. : 4,463,925

DATED : August 7, 1984

INVENTOR(S) : Vernon R. Schimmel

It is certified that error appears in the above-identified patent and that said Letters Patent is hereby corrected as shown below:

Column 9, line 1, "20" should be -- 8 --.

Signed and Sealed this

*Thirtieth* Day of *April 1985*

[SEAL]

*Attest:*

DONALD J. QUIGG

*Attesting Officer*

*Acting Commissioner of Patents and Trademarks*